US012357041B1

(12) United States Patent
Desmeules

(10) Patent No.: US 12,357,041 B1
(45) Date of Patent: Jul. 15, 2025

(54) BULLETPROOF WEARABLE WITH HEAT CONTROL

(71) Applicant: Brooke Erin DeSantis, Montreal (CA)

(72) Inventor: Alain Desmeules, Montreal (CA)

(73) Assignee: Brooke Erin DeSantis, Montreal (CA)

( * ) Notice: Subject to any disclaimer, the term of this patent is extended or adjusted under 35 U.S.C. 154(b) by 0 days.

(21) Appl. No.: 18/586,649

(22) Filed: Apr. 27, 2024

(30) Foreign Application Priority Data

Mar. 16, 2024 (CA) ..... CA 3232483

(51) Int. Cl.
*A41D 13/005* (2006.01)
*F41H 1/02* (2006.01)

(52) U.S. Cl.
CPC ..... *A41D 13/0051* (2013.01); *F41H 1/02* (2013.01)

(58) Field of Classification Search
CPC ..... A41D 13/0051; F41H 1/02
See application file for complete search history.

(56) References Cited

U.S. PATENT DOCUMENTS 3,891,996 A 7/1975 Leach et al.
4,485,491 A 12/1984 Rassmussen
4,507,802 A 4/1985 Small
4,696,066 A * 9/1987 Ball ..... A41D 13/0051 2/912
4,964,282 A 10/1990 Wagner
5,032,705 A * 7/1991 Batcheller ..... H05B 3/342 219/211
6,439,942 B1 * 8/2002 Pillai ..... B63C 9/11 441/106
2010/0089897 A1 * 4/2010 Bart ..... A61F 7/034 2/243.1
2012/0295057 A1 11/2012 Atorrasagasti
2013/0319031 A1 12/2013 Coats, IV et al.
2014/0013482 A1 1/2014 DiBernardo et al.
2014/0069617 A1 3/2014 Shelton
2015/0230524 A1 * 8/2015 Stevens ..... H05B 1/02 219/494

(Continued)

FOREIGN PATENT DOCUMENTS

WO WO-0024277 A1 * 5/2000 ..... A41D 13/0051
WO WO-03059099 A1 * 7/2003 ..... A41D 13/0051

(Continued)

*Primary Examiner* — Tajash D Patel
(74) *Attorney, Agent, or Firm* — Guy J. Houle; HOULE PATENT AGENCY, Inc

(57) ABSTRACT

A bulletproof article of apparel is provided with an opening in an inner lining thereof for access to a configured space adapted to receive a bulletproof panel and an electrically heating panel having electrical heating conductors. A dc voltage supply cable is secured to the electrical heating conductors to provide comfort to a wearer person during cold climatic conditions. A controller module is secured to the dc voltage supply cable and to a dc battery to control a supply voltage to the electrical heating conductors. The controller module is retained at a location accessible to a wearer person fitted with the bulletproof article of apparel and has a switch to permit the wearer person to switch the battery power on/off and regulate the voltage supply to the electrical heating conductors. Feedback means informs the wearer person of the operating mode provided by a switch actuation by the wearer person.

21 Claims, 7 Drawing Sheets

(56) References Cited

U.S. PATENT DOCUMENTS

| | | | | |
|---|---|---|---|---|
| 2019/0045857 | A1 | 2/2019 | Fan et al. | |
| 2022/0265981 | A1* | 8/2022 | Glover | A61F 7/02 |
| 2023/0389630 | A1* | 12/2023 | Desmeules | H05B 1/0272 |

FOREIGN PATENT DOCUMENTS

| | | | | |
|---|---|---|---|---|
| WO | WO-2015050976 | A1 * | 4/2015 | A41D 13/0051 |
| WO | WO-2019016524 | A1 * | 1/2019 | A41D 13/0051 |
| WO | WO-2025000058 | A1 * | 1/2025 | |

* cited by examiner

BULLETPROOF WEARABLE WITH HEAT CONTROL

FIELD OF INVENTION

The present invention relates to bulletproof wearables and more particularly to electrical heating panels removably incorporated therewith to keep the wearer person warm in cold environments.

BACKGROUND OF THE INVENTION

Bulletproof vests or other form of apparel offer protection to a wearer person against ballistics projected thereagainst and these are used predominantly by police personnel, military and other people exposed to environments where there is the risk of being subjected to such harmful and deadly projectiles. However, there are disadvantages of wearing these bulletproof protective apparels. One disadvantage is the weight of such wearable wherein a bulletproof vest usually weighs in the range of 20 lbs to 25 lbs. A further disadvantage is its bulkiness, particularly when worn under an outer garment during cold weather conditions adding weight and restrictive arm movement to the wearer person. This presents several disadvantages to police personnel and military when on duty outside during cold weather days when an outer warm garment is dawn over the bulletproof vest and severely restricting the arm motions of the wearer person when confronted with a crisis situation involving an armed opponent. It is challenging for armed forces personnel wearing bulletproof vests to stay warm in cold weather conditions without significantly restricting their movement by wearing a bulky and oversized winter jacket over the bulletproof vest.

It would be advantageous to provide a means to overcome the above-mentioned disadvantages to people wearing bulletproof apparels by a means for the bulletproof vest to actively warm up and thermoregulate the body temperature of the wearer person.

BRIEF SUMMARY OF THE INVENTION

It is therefore a feature of the present invention to provide a bullet proof article of apparel which is adapted to removably contain one or more electrically heating panels to overcome the above-mentioned disadvantages.

Accordingly, it is a feature of the present invention to provide a bulletproof article of apparel in which there is incorporated in its structure one or more electrical heating panels to generate instant and regulated heat to the wearer person's body or adapted to receive one or more removable heating panels.

It is a further feature of the present invention to provide a bulletproof article of apparel incorporating therein one or more electrical heating panels and wherein a control is made accessible to the wearer person to control the operation and heat intensity of such heating panel(s) and to manage portable battery power.

A still further feature of the present invention is to provide a bulletproof article of apparel incorporating therein one or more electrical heating panels which are of light weight film construction laminated on a high density thermally insulating foam panel whereby to insulate the heating panel form the ballistic plate. This insulation serves two main functions, firstly it prevents the degradation of the ballistic plate performance due to excessive heat, and secondly it prevents the ballistic plate from acting as a heat sink which would otherwise reduce the efficiency of the heating conductors. By insulating the ballistic plate, most of the heat generated by the heating conductors is directed towards the body of the wearer person ensuring that the heating is not adversely affected by external temperatures of the coldness of the ballistic plate.

Another feature of the present invention is to provide a bulletproof vest incorporating therein one or more electrical heating panels which permits a wearer person to be free of bulky clothing or provide for light wear outerwear when in a potentially dangerous environment during cold weather conditions and providing to the wearer person more freedom of arm movement and eliminating the need to dawn bulky outer wear when in an air-conditioned vehicle.

A further feature of the present invention is to provide a bulletproof article of apparel adapted to incorporate therein one or more removable electrical heating panels and wherein the bulletproof vest is pre-wired with connectors to permit the one or more electrical heating panels to be quickly connected to a control and a battery supply and disconnected therefrom when the heating panels are not required during warm weather conditions.

A still further feature of the present invention is to provide a bulletproof article of apparel adapted to incorporate therein one or more electrical heating panels and wherein a control is provided in a small compact push-button flap or any other attaching means secured to the article of apparel providing easy access to the wearer person to control the supply of power to the heating panel(s) by a push-button switch mounted on the flap.

A further feature of the present invention is to provide a bulletproof article of apparel incorporated with one or more electrical heating panels which are controlled by a controller integrated having a push-button switch to control on/off power supply and heat intensity levels and wherein selected switch settings are transmitted to the wearer person by lights or haptic signals.

Another feature of the present invention is to provide a bulletproof article of apparel having one or more pockets formed therein behind the outer bulletproof panels and accessible through a slit opening formed in an inner lining to permit ease of installation of electrically heating panels and the removal thereof.

A further feature of the present invention is to provide a bulletproof article of apparel having one or more electrical heating panels removably incorporated in pockets therein and wherein such article of apparel is pre-wired with connectors to connect battery supply voltage wiring to the electrical heating panels and wherein the control and battery supply are remotely supported from the electrical heating panels and wherein one or more power supply batteries can be made accessible to the wearer person.

A still further feature of the present invention is to provide a bulletproof article of apparel having one or more electrical heating panels removably incorporated therein in concealed pockets and wherein two or more dc batteries with magnetically connecting ports are supported in battery holding pockets attached to a waist belt or or elsewhere on the bulletproof vest and providing for quick swapping of batteries when a depleted connected battery is depleted of its charge and thereby permitting a wearer person to prolong its stay outside under cold weather conditions.

A further feature of the present invention is to provide a bulletproof article of apparel having one or more removable bulletproof panels and heating panels permitting the article of apparel to be washed by removing the bulletproof panels and the heating panels.

Another feature of the present invention is to provide a retrofit heating panel for removable insertion behind a bulletproof panel and facing the body of a wearer person. The heating panel could also be provided with monitoring devices and sensors for monitoring vital signs of the wearer person and/or detecting the bulletproof panel integrity as well as transmission means to transfer the data to the wearer person or others remotely.

A further feature of the present invention is that the heating panel could be equipped with a smart controller and various sensors, such as temperature probes to monitor body temperature and external temperature. The heating panel could also have an accelerometer device secured thereto to assess movement. A proximity sensor could also be secure to the heating panel to detect when the bulletproof vest is being worn and to assure that the power supply is disconnected when the vest is not worn, see my U.S. patent application Ser. No. 17/882,688 filed on Aug. 8, 2022 and entitled "Presence Detection System For Heated Wearables". Other body monitoring devices can also be adapted the heating panel and for transmission of relating data to the wearer person or remotely to others.

Another feature of the present invention is that the heating functionality of the electric heating panel, can be operated remotely by a Bluetooth, Registered Trademark, connection to a smartphone. Such capability would negate the necessity for a physical control button, as the system's operation, including intensity adjustments and power state control, could be managed through the smart functionality of an electronic controller or adjusted remotely.

According to the above features, the present invention provides a bulletproof article of apparel comprised of an outer fabric shell adapted to incorporate ballistic absorbing properties. An inner lining is secured to the outer fabric shell with an opening formed in the inner lining to provide access to a configured space or pocket formed behind the outer fabric shell. An electrical heating panel, formed of a material to which is incorporated a pattern of one or more electrical heating conductors, is removably retained in the configured space. A dc voltage supply cable is adapted to be secured to the one or more electrical heating conductors. A controller module is securable to the dc voltage supply cable and to a dc battery to control a supply voltage to the one or more electrical heating conductors. The controller module is retained at a location accessible to a wearer person fitted with the bulletproof article of apparel. The controller module has a switch accessible to the wearer person for switching the battery power on/off and regulating the supply of voltage to the one or more electrical heating conductors. A feedback means informs the wearer person of the operating mode provided by a switch actuation by the wearer person.

BRIEF DESCRIPTION OF THE DRAWINGS

The present invention will now be described, by way of example, with reference to the accompanying drawings in which.

DETAILED DESCRIPTION OF THE INVENTION

Before any embodiments of the application are explained in detail, it is to be understood that the application is not limited to the details of construction and the arrangement of component part set forth in the following description or illustrated by the drawings. Further, it is to be understood that the phraseology and terminology used herein is for the purpose of description and should not be regarded as limiting but should encompass equivalents thereof.

Figure 1:
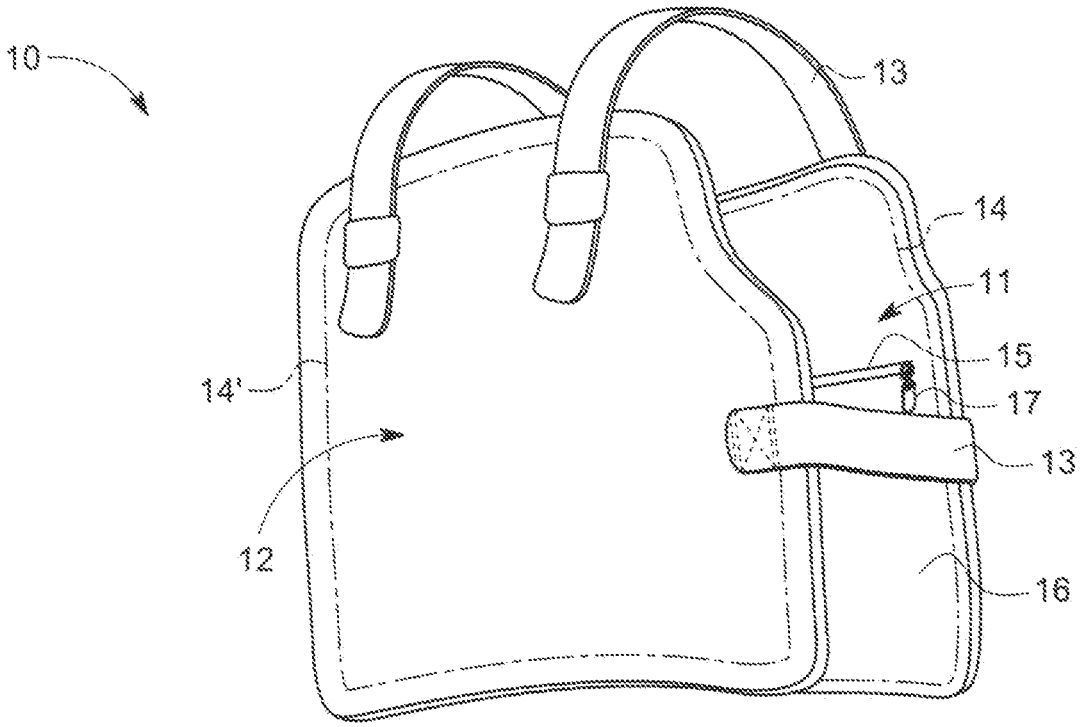
FIG. 1 (PRIOR ART)
FIG. 1 is a perspective view of a prior art article of apparel in the form of a ballistic protective vest provided with a front and rear adjustable panel adapted to be comfortably worn by wearer persons of different body sizes and wherein the panels are each formed with a large pocket accessible from the rear thereof to receive a bulletproof panel therein.

Referring now to the drawings, and more specifically to FIG. 1, there is illustrated a bulletproof article of apparel 10 of the prior art for protection of the upper body of a wearer person against ballistics shot at it. The bulletproof article of apparel 10 herein shown is comprised of a front fabric panel 11 and rear fabric panel 12 interconnected together by adjustable straps 13 whereby to be worn comfortably by wearer persons of different body sizes. Each of the fabric panels 11 and 12 are formed with a large internal pocket accessible from the rear thereof through a slit 15 formed in the inner lining 16 to receive a bulletproof panel 14 and 14' shaped to fit in the respective pockets. Accessibility to the pocket is provided by a zipper closure 17 or other types of closures, is provided to close the slit opening. The bulletproof panels 14 and 14' could also be formed of several types of construction such as a plurality of layered woven fabric sheets of high strength, high modulus, fibers or polyimide products bonded in a solution of polyamide to form a high strength bulletproof panel. Several other types of bulletproof panels are known in the art and do not form part of the present invention.

Figure 2:
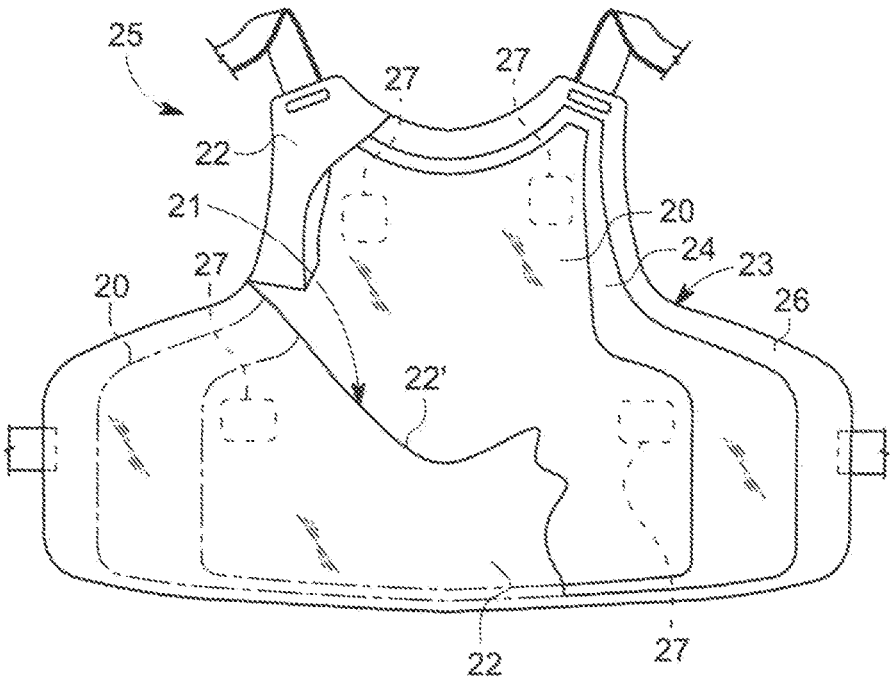
FIG. 2 is a fragmented rear view of a differently shaped bulletproof vest and incorporating therein an electrical heating panel of the present invention to provide warmth to the wearer person and wherein the heating panel is positioned behind the bulletproof panel facing the wearer person's body.
Figure 3:
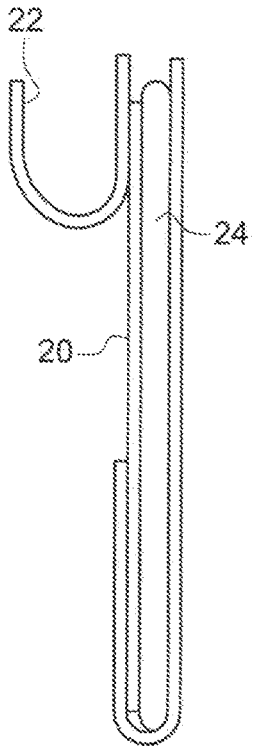
FIG. 3 is a cross-sectional view of FIG. 2.

As shown in FIGS. 2 and 3, the present invention relates to a modification of known bulletproof articles of apparel 25 wherein an electrical heating panel 20 is constructed and shaped for insertion into a pocket 21, formed between an outer shell 26 and an inner lining 22 into which is contained the bulletproof panel. The bulletproof article of apparel as shown in FIG. 2 is in the form of a large apron 23 to protect the front chest portion and opposed rib cage portions of a wearer person's body, however, but the present invention is not to be limited to this specific shape of protective garment an could apply to other wearables, such as pants, head wear, etc. A slit 22' is formed in the inner lining 22 for access to the interior of the pocket 21, as shown in FIG. 3, for the insertion of the electrical heating panel 20 behind the bulletproof panel 24 or a bulletproof outer shell construction, not shown, but obvious to a person skilled in the art. As also shown, the pocket 21 may have different configurations according to the body area to be protected and to firmly hold the bulletproof panel 24 in position. Likewise, the electrical heating panel is formed with a shape of a dimension sufficient to heat the body of the wearer person. The panels are maintained firmly in position by their rigidity or by attachments, such as hook and loops patches 27 or snaps and other detachable attachments as is obvious to a person skilled in the art. The heating panel may also be configured to fit into most bulletproof vests and could be of different standard sizes, such as small, medium, large, etc., to fit into vests of corresponding standard sizes. By the removal of the bulletproof panel 24 and the heating panel 20, it also makes it possible to wash the article of apparel 25.

Figure 4:
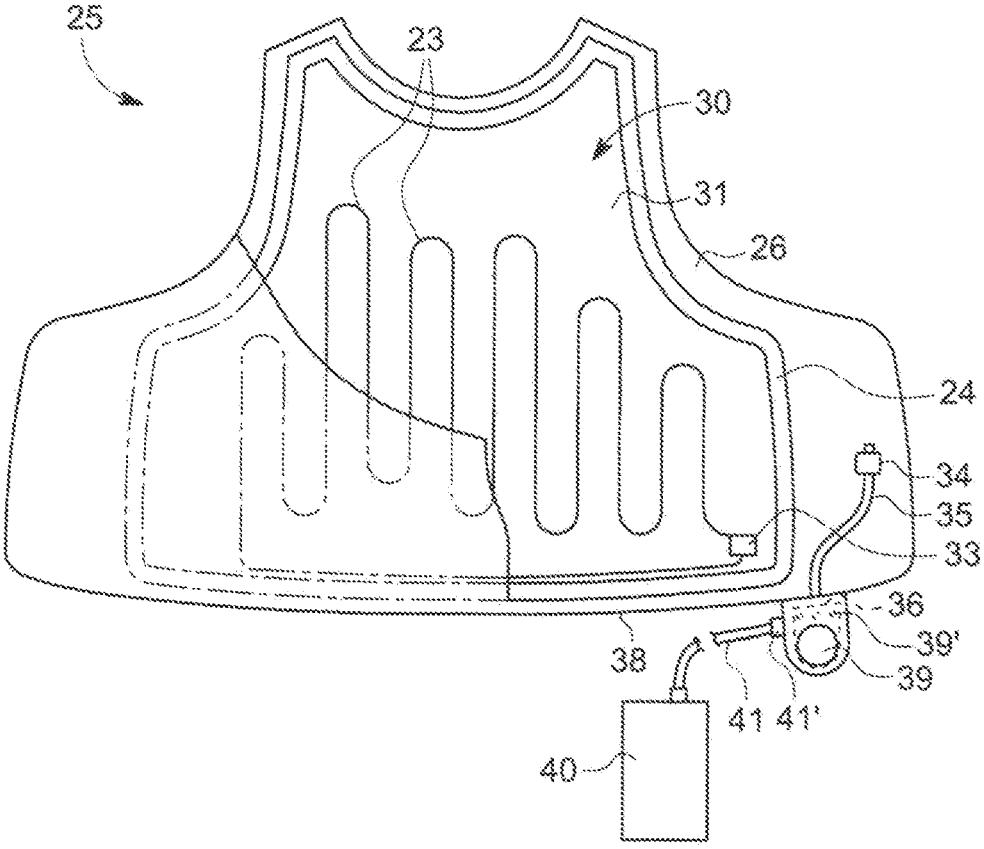
FIG. 4 is a fragmented rear view, similar to FIG. 2, illustrating a flap secured to the vest at a bottom front edge thereof and to which is secured a controller module with a button switch and through which a supply voltage to the heating wires of heating panel is connected and controlled.
Figure 5:
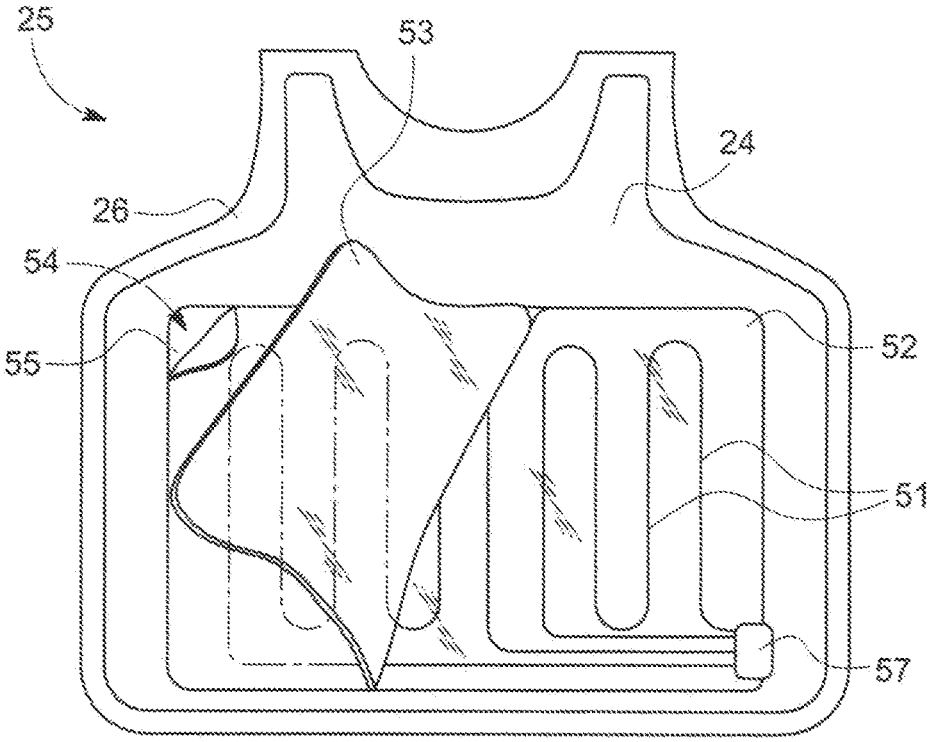
FIG. 5 is a further fragmented rear view illustrating a differently constructed electrical heating panel formed of a lightweight film material and mounted in the pocket behind the bulletproof panel and an inner lining not illustrated.

Referring now to FIGS. 4 and 5, there is described two types of electrical heating panels of different construction, but the present invention is not limited thereto. As shown in FIG. 4, the electrical heating panel 30 is formed of a fabric material 31 into which is incorporated, in a fireproof arrangement, a pattern of one or more electrical heating conductors 32 disposed in a pattern to supply substantially constant heat throughout the panel 30 to provide heat to the body of the wearer person. Electrical heating panels of many different constructions are also known in the art. As herein shown, an input connector 33 is secured to the input and output ends of the conductor pattern or patterns, for receiving a power supply connector 34 of a power supply cable 35 permanently and conveniently mounted in the bulletproof article of apparel 25 and to a controller module 36 secured to a flap 37 permanently attached to the lower edge 38 of the bulletproof article of apparel. A push-button switch 39 is accessible on the flap 37 to control the power to the heating panel 24. LED lights 39' are also mounted adjacent the push-button switch 39 to indicate to the wearer person the selected mode of operation of the switch. The controller module 36 has a processor with a memory which is programmed to execute certain functions. The controller may therefore be programmed to execute functions related to other devices that may be adapted to the heating panel, such as a presence a sensor to sense the presence of the wearer person, temperature sensors to sense the temperature inside the vest, heartbeat monitor, and other devices to monitor the wearer's vital signs, etc. Reference is made to my co-pending U.S. patent application Ser. No. 17/581,891, filed on Jan. 22, 2022 which describes the construction of the control device. Reference is also made to my co-pending U.S. Pat. No. 882,688, filed on Aug. 8, 2022 and entitled Presence Detection System for Heated Wearables.

The controller module 36 may also be provided elsewhere on the article of apparel and may be concealed as described in above mentioned US Patent Application, and with a haptic communication device providing sensory signals to the wearer person representative of the activated mode of the switch. As herein illustrated, the push-button switch 39 is visually accessible to the wearer person, but may also be concealed at an accessible location, such as in the collar of the article of apparel, to switch power from a battery 40 on/off and to regulate the intensity of the power supplied to the electrical heating panel 30. The different switch modes are activated by the number of switch depressions effected by the wearer person. The communication could also be provided by Bluetooth communication. A power cable 41, provided with end connectors 41' and 41", interconnects the battery to the controller module 36. It is also pointed out that the controller module 36 and its support flap 37 may not form part of the article of apparel with the controller being contained in a pant pocket or removably attached to the vest outer shell and providing power to the resistive heating conductors 32 of the electrical heating panel 30 via a disconnectable power supply cable secured to an exterior connector of the supply cable 35. Temperature sensors, not shown, may also be integrated with the heating panel to provide temperature sensing signals to the controller module to inform the wearer person of the sensed temperature of the heating panel.

Figure 7:
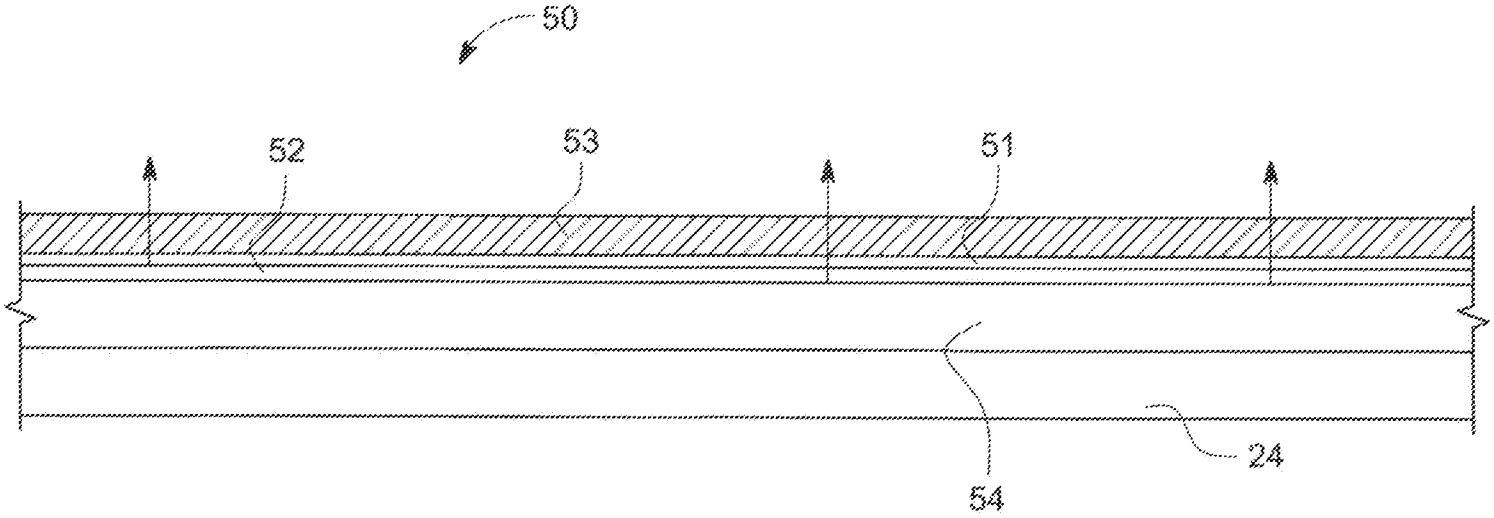
FIG. 7 is a cross-section view illustrating the construction of the film electrical heating panel.

As shown in FIGS. 5 and 7, the electrical heating pad 25 may be formed as a flat flexible film panel 50 with the electrical heating conductors being in the form of one or more patterns of electrically conductive traces 51 formed on an electrically non-conductive backing support film material sheet 52 of the flat film panel. The electrically conductive traces 51 are connected to a connector 57 adapted to receive an electrical connector from a supply cable of a dc battery. A protective film sheet 53 overlies the conductive traces 51 and the backing film material sheet 52 to sandwich and seal the electrically conductive traces 51 therebetween. As shown in FIG. 7, a thermally insulating stabilizing foam sheet 54, which may also be laminated with a reflective metalized surface 55, is bonded to the outer side of the backing film material sheet 52 and the other side to form a stable composite flat sheet support which provides a thermal break with the bulletproof panel and reflect heat towards the body of the wearer person. The thermally insulating foam sheet further prevents the heating panel from deforming of its normal shape. The laminated heating panel can be of varying thickness and be interchangeable if they become damaged by deformation of the ballistic plate when impacted by a ballistic projectile. One advantage of the insulating sheet is to isolate the ballistic plate from the heating panel whereby the projectile arresting properties of the ballistic plate is not affected by heat to reduce the efficiency thereof. The structural properties of the high-density foam sheet also provide rigidity and support to the heating panel making it easy to install by preventing thew heating panel to folds or collapse upon itself. By constructing the heating panel with a film structure, the weight of the heating panel is considerably reduced.

Figure 6:
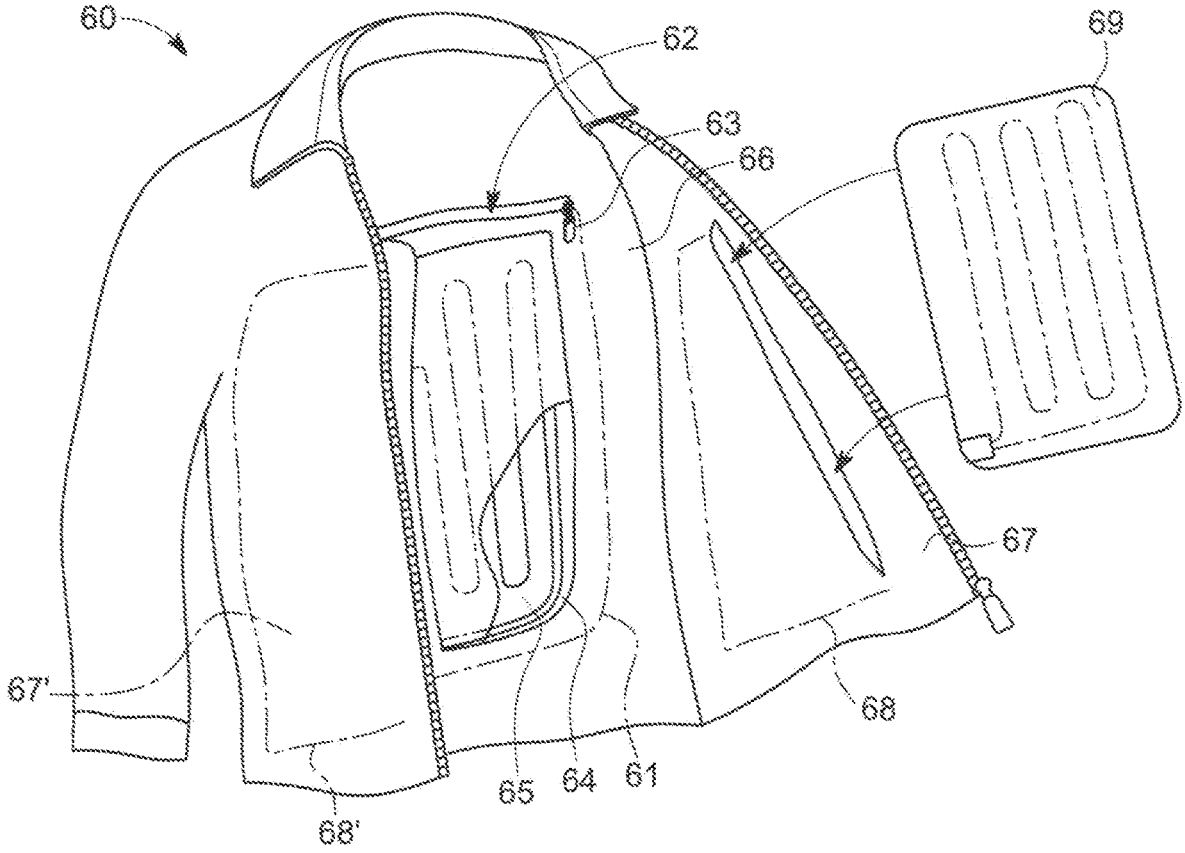
FIG. 6 is a perspective view showing a bulletproof article of apparel in the form of a jacket and wherein there is provided a rear pocket in which is secured a large bulletproof panel and a large heating panel and wherein two frontal pockets are similarly constructed in the front sides of the article of apparel to removably position therein smaller bulletproof panels and electrical heating panels.

FIG. 6 illustrates a different ballistic protective article of apparel herein in the form of a jacket 60 wherein it can be seen that the jacket is formed with a large back pocket 61 having a slit opening 62 provided with a zipper closure 63, or other form of closures, whereby to receive therein a large bulletproof panel 64 and a heating panel 65 facing the inner lining 66. The right and left chest portions 67 and 67' are also formed with pockets 68 and 68' to receive bulletproof panels, not shown, and electrical heating panels 69 to protect the front chest portion of the wearer person against ballistic projectiles and provide warmth the chest of the wearer person.

Figure 8:
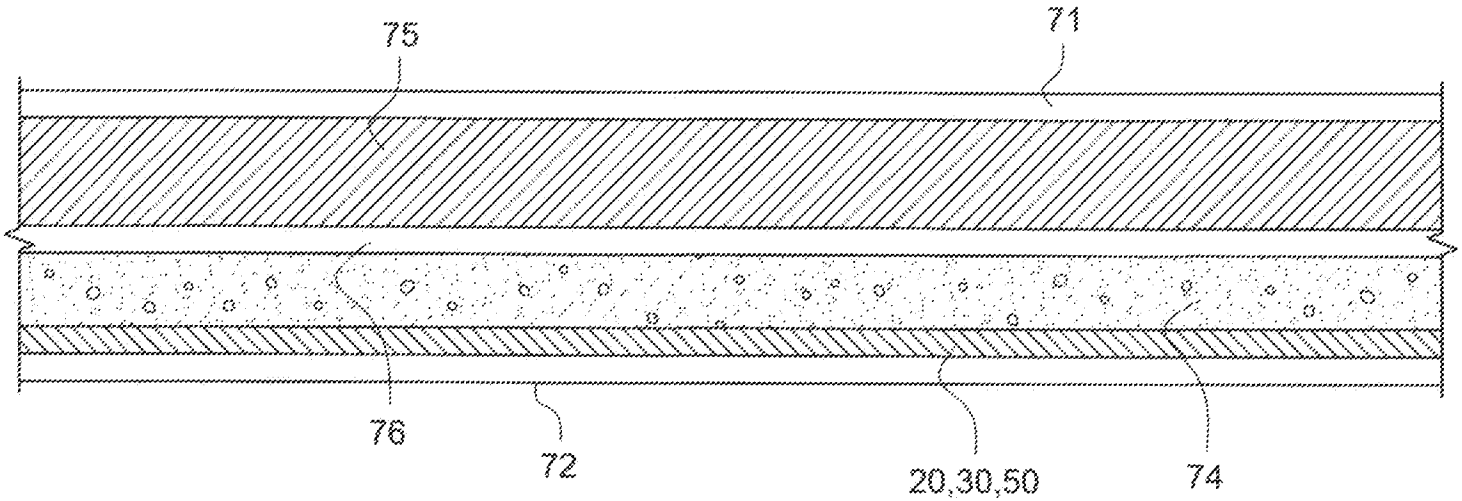
FIG. 8 if a cross-section view illustrating one composition of different layered materials forming the electrical heating panel disposed between the outer shell and the inner lining of the bulletproof article of apparel being in the form of a vest or jacket.

Referring now to FIG. 8, there is illustrated an arrangement of further elements positioned in the inner pocket and disposed between an outer fabric shell 71 and an inner liner 72 and against the bulletproof panel 75 facing inwardly toward the body of the wearer person. As shown, a further thermally insulating and heat reflective panel 73, is formed of a sturdy or rigid foam sheet 74 having a thin aluminum heat reflective sheet 76 bonded to a rear surface thereof and interposed between the bulletproof panel 75 and the heating panel 20, 30, 50, to act has a thermal heat barrier to shield the heating panel from the bulletproof panel 75. The radiant heat barrier is a non-woven, metalized, water vaporproof permeable, polypropylene reflective sheet but could be made of other suitable materials. The metalized surface 76 is disposed against the bulletproof panel 75 to reflect any heat in the direction of the foam sheet 74 inwardly towards the heating panel 20, 30, 50 to minimize heat loss. Other sheeting materials can also be disposed between the bulletproof panel and the electrical heating panel or bonded to an inner surface, as well as fireproof sheeting, cotton sheeting, and polypropylene sheeting, anti static sheeting, Kevlar (Registered Trademark) sheeting whereby to provide additional features to the electrical heating panel or the bulletproof article of apparel.

Figure 9:
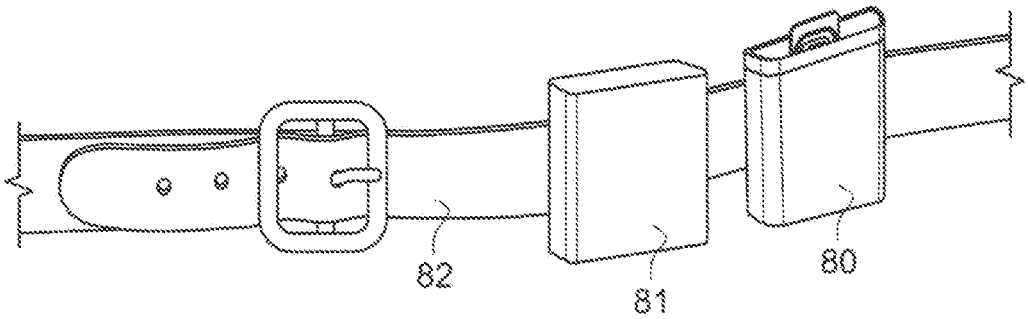
FIG. 9 is a fragmented perspective view illustrating two battery holding pockets attached to a waist belt and wherein one of the pockets is a power supply pocket having a magnetic male battery connector for magnetic coupling with a magnetically coupling dc rechargeable battery when disposed in the pocket and the other pocket being a storage pocket for storing a replaceable magnetically coupling charged dc battery.

It is important for police, security and military personnel to dawn bulletproof article of apparel for prolong periods of times. Therefore, during cold weather conditions it is also important to provide warmth to these people for long periods of time and therefore one or more auxiliary charged batteries should be made available to the wearer person. FIGS. 9 to 12 illustrates a prolonged heat generating heating panel system when combining the electrical heating panel(s) of the present invention with a battery supply system comprised of two or more batteries stored in a battery support worn by the wearer person either in the form of pockets 80, 81 strapped to a belt, or battery holster supported at a convenient location on the bulletproof apparel. With such a system, depleted batteries can be replaced quickly with a new charged battery and automatically connected to the electrical heating panel(s) with minimal visual visibility by the wearer person. Such permits the above-mentioned people such as the military and police to stay warm during long periods of time and particularly when involved a crisis situation. FIG. 9 illustrates one form of providing readily available auxiliary batteries by means of support pockets secured to a belt or other form of wearable harness. As herein shown, one or more battery support pockets 80 and 81 are attached to a waist belt 82 worn by the wearer person the battery support pockets sized for retention of a dc supply battery therein. It is also important for such police and military personnel to make the battery connection simple and quickly connected with minimum visibility. The connection can be made by USB or USBC connectors or by magnetic connectors adapting my invention, as described in my co-pending U.S. patent application Ser. No. 18/244,363, filed on Sep. 11, 2023 which relates to a magnetically coupling rechargeable dc battery and pocket connector.

Figure 10:
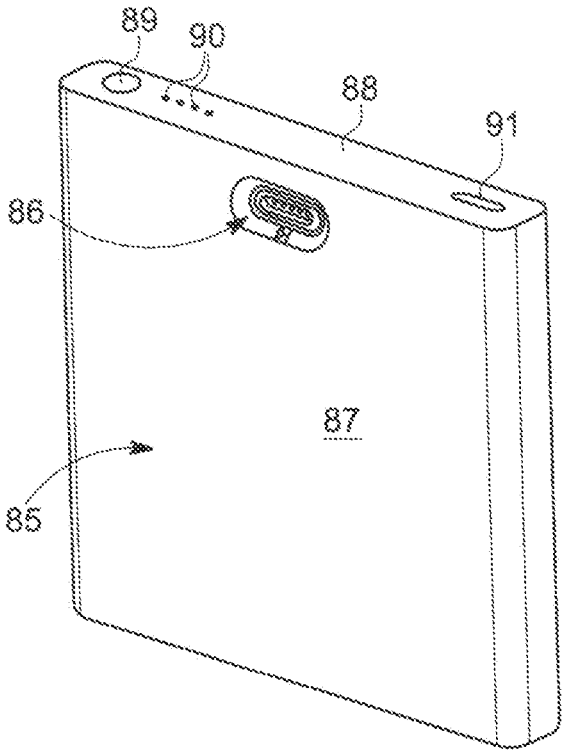
FIG. 10 is a perspective view of a magnetically coupling rechargeable dc battery.
Figure 11:
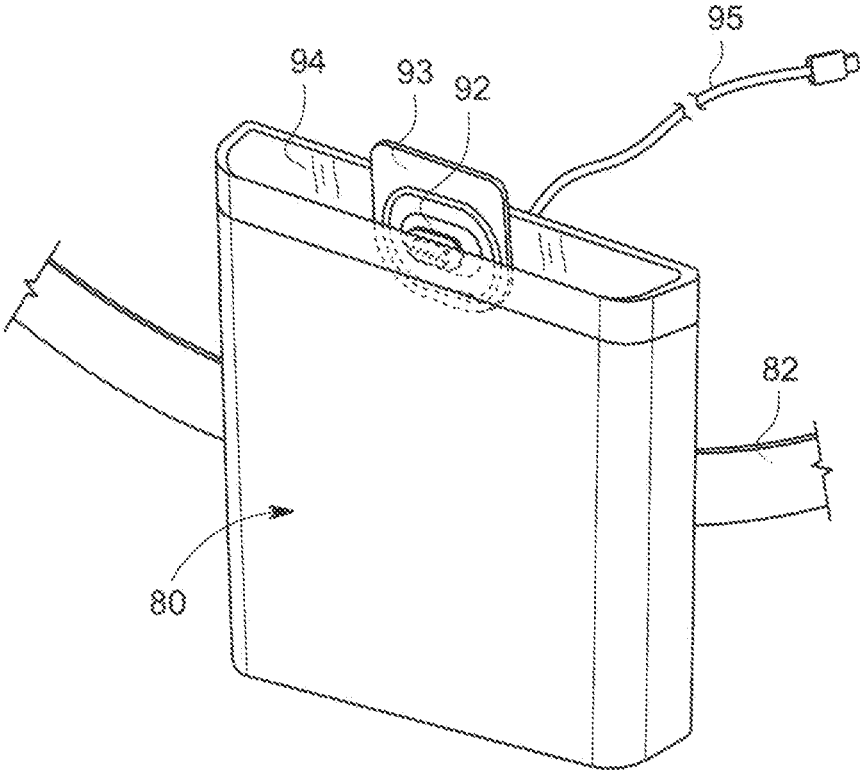
FIG. 11 is an enlarged perspective view of a battery holding pocket of the type shown in FIG. 9.
Figure 12:
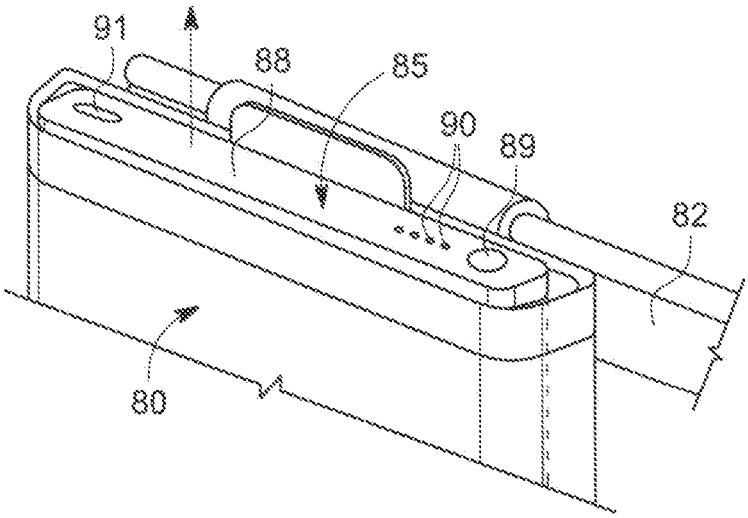
FIG. 12 is a perspective view illustrating a magnetically coupled dc battery disposed in the power supply pocket of FIG. 11 to provide voltage to an input port of the controller module.

FIG. 10 illustrates my rechargeable dc battery 85 which is provided with a magnetically coupling female connecting port 86 formed in a side wall 87 of the battery adjacent a top end wall 88 thereof. Inside the battery, below the top wall 88 of the battery, there is provided an integrated controller mounted therein with a processor (not shown) connected to a push-button switch 89 made available on the top end wall 88. LED lights 90 are also mounted on the top end wall 88 to indicate if the battery is in an on/off state or of the intensity of the voltage setting of the battery selected by the user person by means of switch depressions. A charging port 91 is also mounted on the top end wall for the charging of the battery 85 when depleted of its charge.

With additional reference to FIGS. 9, there is illustrated two battery support pockets 80 and 81 each supporting a battery. A power feed cable 95 is connected to one of the dc batteries and to the supply cable 35 installed in the bulletproof apparel and provides electrical current to the electrical heating panel. In this embodiment, the battery support pocket 80 is a power connectable pocket for automatically connecting the battery 85 to the heating panel 20, 30, 50, via magnetic male magnetic connecting port 92 secured to a support harness 93 attached to a top portion of the rear wall 94 of the pocket 80. The power feed cable 95 is secured to the male magnetic connecting port 92 and exists the pocket 80 for connection to an input connector of the supply cable 35, as illustrated in FIG. 4. The connecting port 92 is positioned at a predetermined position for automatic magnetic coupling with the recessed magnetic electrical connecting port 86 disposed in the top area of a flat rear wall 87 of the dc battery 85 when positioned in the battery support pocket. The other pocket 81 is a battery storage pocket for retaining a charged auxiliary dc battery therein. There may be several of these storage pockets secured to the belt depending on the intended period of time that the heating panel is required to generate heat. My magnetic connecting feature makes it easy to swap batteries, which is an important feature when used by police or military personnel.

As illustrated and described in my above-mentioned patent application Ser. No. 18/244,363, the magnetic connecting port mounted in the pocket is a projecting male connecting port with an electrically insulated magnet and the battery magnetic connecting port is a recessed connecting port with also an electrically insulated magnet. When these connecting ports are positioned close to one another, when the dc battery is positioned in close fit in the pocket 80, they are automatically attracted to one another and become electrically coupled to one another. Therefore, all that is required for the user person is to swap the depleted battery in the pocket 80 for a charged battery from the pocket 81 and no connections are required to be made by the user person. This can be done without distracting the wearer person and done simply by hand and feel manipulation.

It is within the ambit of the present invention to also adapt the electrical heating panel, in combination with a bulletproof wearable, with Integrated health monitoring and ballistic panel damage detection features. Therefore, in addition to providing regulated warmth to armed forces and police personnel through electrically heated panels, the present invention introduces the possibility of having a multifunctional layer capable of monitoring vital signs and/or detecting the bulletproof panel integrity. The heated panel, in close proximity to the wearer's body, is not only designed for thermal regulation but also may incorporate basic or advanced biometric sensors. These sensors are capable of continuously monitoring the wearer's vital signs, including but not limited to heart rate, blood pressure, and potentially other critical health metrics such as oxygen saturation (SpO2), respiratory rate, and skin temperature.

The integration of a smart controller, along with a dedicated power source such as a dc battery, enables real-time data processing and health status assessment. Connectivity modules, including cellular, Wi-Fi, and Bluetooth technologies, facilitate remote communication, allowing vital data transmission to command centers or medical teams, ensuring immediate response in critical situations.

Still further, the wearable may be equipped with damage detection sensors embedded within or alongside the heated panels. These sensors are designed to identify and alert to penetrations or compromises in the vest's integrity caused by ballistic impacts or sharp objects, enabling rapid assessment of potential injuries and the vest's protective capabilities.

In cases where vital signs indicate severe distress or life-threatening conditions, or when a breach in the vest's integrity is detected, the system can automatically initiate emergency protocols. This includes sending alerts to the wearer or their team, pinpointing the wearer's location for immediate assistance, and activating predefined emergency medical response actions. This comprehensive approach not only enhances the wearer's survivability in hostile environments by maintaining optimal body temperature but also provides a critical layer of health monitoring and injury detection. The dual functionality, combined with advanced connectivity, represents a significant leap forward in protective wearables, offering unprecedented support to military and law enforcement personnel.

Many modifications and other embodiments of the present invention as described above will come to mind to a person skilled in the art to which the invention pertains having the benefit of the teachings described herein above and the drawings. Hence, it is to be understood that the embodiments of the present invention are not to be limited to the specific examples thereof as described herein and other embodiments are intended to be included within the scope of the present invention and the appended claims. Although the foregoing descriptions and associated drawings describe example embodiments in the context of certain examples of the elements and/or functions, it should be understood that different combinations of elements or substitutes and/or functions may be provided by different embodiments without departing from the scope of the present invention as defined by the appended claims. Furthermore, although specific terms are employed herein, they are used in a generic and descriptive sense only and other equivalent terms are contemplated herein with respect to the items that they relate to. It is therefore within the ambit of the resent invention to encompass all obvious modifications of the examples of the preferred embodiment described herein provide such modifications fall within the scope of the appended claims.

The invention claimed is:

1. A bulletproof article of apparel comprising a fabric shell adapted with ballistic absorbing properties, an electrical heating panel formed of a material to which is incorporated a pattern of one or more electrical heating conductors, said electrical heating panel being removably retained in a configured space behind said ballistic absorbing properties of said fabric shell, a dc voltage supply cable adapted to be secured to said one or more electrical heating conductors, a controller module securable to said dc voltage supply cable and to a dc battery to control a supply voltage to said one or more electrical heating conductors, said controller module being retained at a location accessible to a wearer person fitted with said bulletproof article of apparel, said controller module having a switch function accessible to said wearer person for switching said battery power on/off and regulating the voltage supply to said one or more electrical heating conductors, and feedback means to inform said wearer person of the operating mode selected by a switch actuation made by said wearer person.

2. The bulletproof article of apparel as claimed in claim 1 wherein said ballistic absorbing properties are provided by a ballistic absorbing panel positioned in said configured space, said electrical heating panel being positioned behind said ballistic absorbing panel adjacent an inner lining of said fabric shell and facing a wearer persons body when wearing said bulletproof article of apparel.

3. The bulletproof article of apparel as claimed in claim 2 wherein there is further provided a thermally insulating sheet secured to a face of said electrical heating panel and adapted to be positioned facing said ballistic absorbing panel when said electrical heating panel is positioned into said configured space.

4. The bulletproof article of apparel as claimed in claim 2 wherein said configured space is a pocket formed in said fabric shell and accessible through an access opening formed in said inner lining, said configured space being shaped in the form of said ballistic absorbing panel for holding said ballistic absorbing panel firmly in position therein.

5. The bulletproof article of apparel as claimed in claim 4 wherein said access opening in said inner lining is provided with a closure member, said closure member being one of a flap secured to said inner lining and disposed to overly said access opening, a zipper closure and other releasably securable closure.

6. The bulletproof article of apparel as claimed in claim 2 wherein said electrical heating panel is a flat heating panel shaped to overly at least a major portion of said ballistic absorbing panel immovably retained in said configured space.

7. The bulletproof article of apparel as claimed in claim 3 wherein said thermally insulating sheet is a thermally insulating foam sheet and wherein a radiant heat barrier is bonded to a surface of said thermally insulating foam sheet on a side thereof facing said ballistic absorbing panel.

8. The bulletproof article of apparel as claimed in claim 7 wherein said radiant heat barrier is a non-woven, metalized, water vapour permeable, reflective sheet.

9. The bulletproof article of apparel as claimed in claim 7 wherein a thin aluminum sheet is bonded to an outer face of said thermally insulating foam sheet to reflect heat in the direction of said foam sheet towards an outer surface of said electrical heated flat panel and toward a wearer person's body.

10. The bulletproof article of apparel as claimed in claim 1 wherein an electrical connector is secured to input and output ends of said one or more electrical heating conductors for electrical coupling to a voltage supply connector secured to said controller module.

11. The bulletproof article of apparel as claimed in claim 1 wherein said controller module is supported for easy access by said wearer person, said switch function being provided by one of a finger actuating push-button switch to module having control the supply of voltage to said electrically heating panel and a touch switching display on a computerized device, said feedback means being constituted by switch actuating depression transmitting means to transmit to an indicator device said operating mode selected by the wearer person.

12. The bulletproof article of apparel as claimed in claim 11 wherein said indicator device is constituted by one of one or more visual indicating led lights provided on said controller module and a haptic signal transmitting device secured to said wearer person for sensory detection by said wearer person.

13. The bulletproof article of apparel as claimed in claim 11 wherein said controller module is permanently secured to a fabric flap extending from a lower front edge of said bulletproof article of apparel for ease of access and switch operation by said wearer person.

14. The bulletproof article of apparel as claimed in claim 1 wherein said dc battery is a rechargeable do battery, said bulletproof article of apparel is provided in combination with one or more battery support pockets positioned for ease of access by a wearer person to form a combined prolong heat generating system, said battery support pockets being sized for retention of said rechargeable do battery therein.

15. The bulletproof article of apparel as claimed in claim 14 wherein one of said one or more battery support pocket has a male magnetically coupling electrical connector secured therein for electrical coupling connection with a mating female magnetically coupling electrical connector of said rechargeable de battery when said rechargeable do battery is positioned in said battery support pocket.

16. The bulletproof article of apparel as claimed in claim 15 wherein said male electrically coupling magnetic connector is permanently bonded on a fabric harness which is permanently secured in said battery support pocket to mount said male electrical connector in a top area of said pocket at a predetermined position for automatic magnetic coupling with said female electrically coupling magnetic connector disposed at a predetermined location in a top area of a flat rear wall of said dc battery when positioned in said battery support pocket.

17. The bulletproof article of apparel as claimed in claim 1 wherein there is further provided auxiliary battery support means for the storage of additional dc batteries to permit said wearer person to swap charged auxiliary batteries with said dc battery connected to said controller module when depleted of its charge.

18. The bulletproof article of apparel as claimed in claim 1 wherein said electrical heating panel is a flat composite flexible film panel, said electrical heating conductors being in the form of one or more patterns of electrically conductive traces formed in a support film material sheet of said flat film panel.

19. The bulletproof article of apparel as claimed in claim 1 wherein said electrical heating panel is a fire-resistant fabric panel containing a pattern of electrically heating conductors secured thereto.

20. The bulletproof article of apparel as claimed in claim 2 wherein said ballistic absorbing panel and said electrical heating panel are provided with detachable fasteners for holding said electrical heating panel firmly in position behind said ballistic absorbing panel.

21. The bulletproof article of apparel as claimed in claim 6 wherein said ballistic absorbing panel and said electrical heating panel are formed of like shape and define a front chest portion and opposed rib cage portions to protect the upper body of a wearer person.

* * * * *